US006221183B1

(12) United States Patent
Sato et al.

(10) Patent No.: US 6,221,183 B1
(45) Date of Patent: Apr. 24, 2001

(54) HIGH-STRENGTH AND LOW-THERMAL-EXPANSION ALLOY, WIRE OF THE ALLOY AND METHOD OF MANUFACTURING THE ALLOY WIRE

(75) Inventors: Koji Sato, Yasugi; Rikizo Watanabe, Mooka; Takehiro Ohno; Yoshiki Masugata, both of Yasugi; Minoru Takuwa, Matsue; Shigeaki Sato, Tottori-ken; Yoshimi Senda, Yonago, all of (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 08/151,808

(22) Filed: Nov. 15, 1993

(30) Foreign Application Priority Data

| | | |
|---|---|---|
| Nov. 16, 1992 | (JP) | 4-305186 |
| Mar. 26, 1993 | (JP) | 5-067807 |
| Jun. 10, 1993 | (JP) | 5-138558 |
| Jun. 16, 1993 | (JP) | 5-144626 |
| Jun. 16, 1993 | (JP) | 5-144627 |

(51) Int. Cl.[7] ..... C22C 38/08; C22C 38/10

(52) U.S. Cl. ..... 148/505; 148/506; 148/325; 148/327; 148/336; 148/425; 148/442; 420/36; 420/38; 420/95; 420/107; 420/119; 420/435; 420/436; 420/440; 420/581

(58) Field of Search ..... 148/599, 325, 148/336, 327, 425, 442, 333, 335, 505, 506; 420/95, 119, 440, 435, 436, 581, 36, 38, 104, 107, 112

(56) References Cited

U.S. PATENT DOCUMENTS

| | | | | |
|---|---|---|---|---|
| 3,093,519 | * | 6/1963 | Decker et al. | 148/336 |
| 4,203,782 | * | 5/1980 | Yamada et al. | 148/336 |

FOREIGN PATENT DOCUMENTS

| | | |
|---|---|---|
| 55-131155 | 10/1980 | (JP) . |
| 60-34613 | 8/1985 | (JP) . |
| 2-55495 | 11/1990 | (JP) . |
| 3-166340 | 7/1991 | (JP) . |
| 4-354848 | 12/1992 | (JP) . |

OTHER PUBLICATIONS

"Effect of processes of drawing on torsional property of high–tensile strength Invar alloy wire", Hamada et al., Wire Journal International, vol. 21, No. 4, pp. 84, 85 & 94, Apr. 1988.

* cited by examiner

*Primary Examiner*—Sikyin Ip
(74) *Attorney, Agent, or Firm*—Finnegan, Henderson, Farabow, Garrett & Dunner, L.L.P.

(57) ABSTRACT

A high-strength low-thermal-expansion alloy consisting of, by weight, 0.06 to 0.50% C, 25 to 65% in total of one or both of 65% or less Co and less than 30% Ni, and balance of Fe as a main component, other optional elements and unavoidable impurities, and having a primary phase of austenite phase and martensite phase induced by working. A wire is made from the alloy.

12 Claims, 1 Drawing Sheet

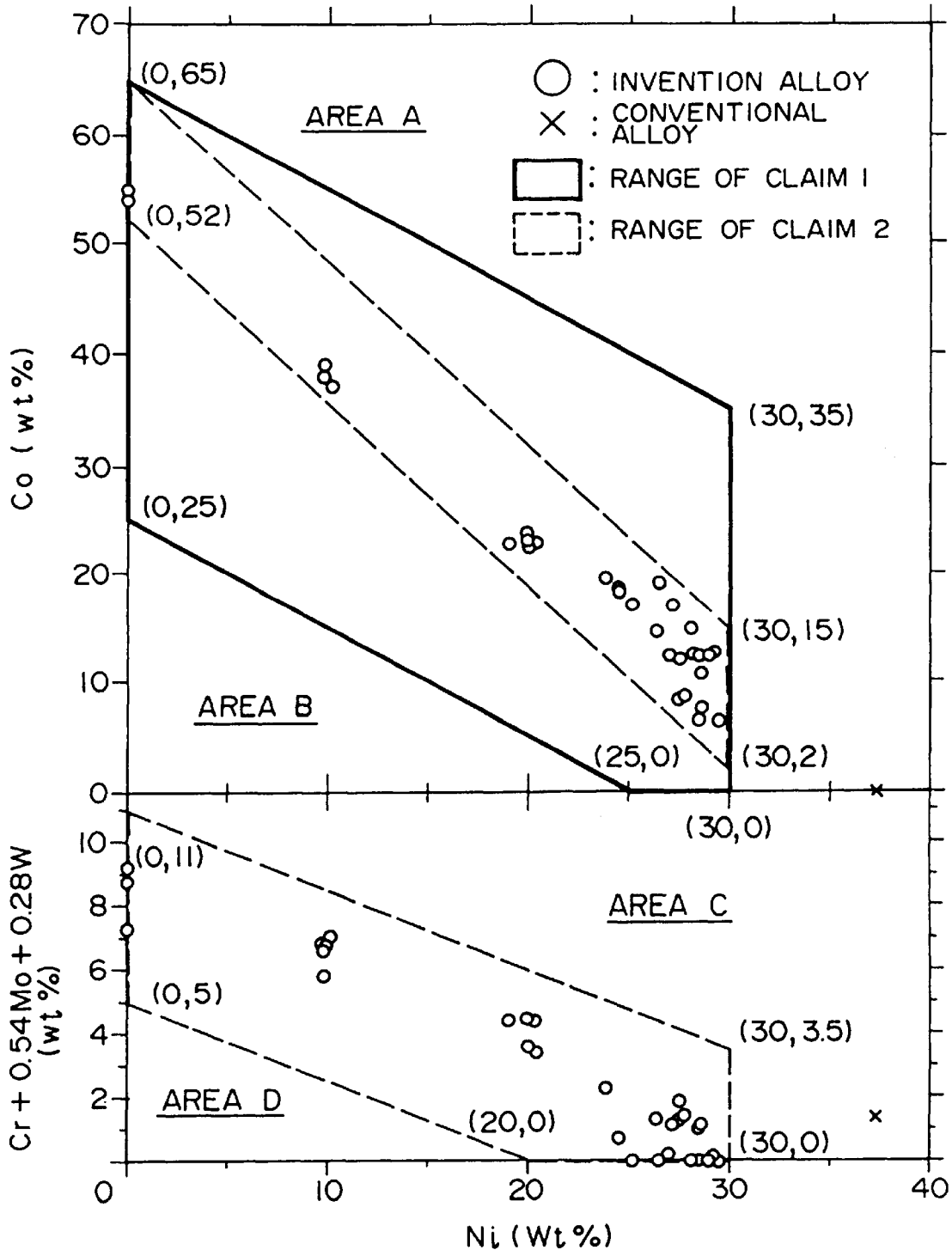
: INVENTION ALLOY
: CONVENTIONAL ALLOY
: RANGE OF CLAIM 1
: RANGE OF CLAIM 2
AREA A
AREA B
AREA C
AREA D
(0,65)
(0,52)
(0,25)
(30,35)
(30,15)
(30,2)
(25,0)
(30,0)
(0,11)
(0,5)
(30,3.5)
(20,0)
(30,0)
Co (wt%)
Cr + 0.54Mo + 0.28W (wt%)
Ni (Wt%)
0
10
20
30
40
50
60
70
2
4
6
8

HIGH-STRENGTH AND LOW-THERMAL-EXPANSION ALLOY, WIRE OF THE ALLOY AND METHOD OF MANUFACTURING THE ALLOY WIRE

BACKGROUND OF THE INVENTION

1. Industrial Field of the Invention

The present invention relates to a high-strength and low-thermal-expansion alloy employed for high-accuracy mechanical parts which may be deteriorated due to elevation of temperature in use, heat resistant core wires of a low sag grade for power-transmission lines or the like. It further relates to a high-strength and low-thermal-expansion wire made of the alloy, and to a method of manufacturing the alloy wire.

2. Prior Art

Conventionally, an aluminum wire strand having a steel core (referred to as ACSR wire) has been utilized as an overhead power-transmission line. Due to an increase in power demand and the rise in land prices in recent years, however, there has been an increasing demand for a core wire having a high strength and a low coefficient of thermal expansion in place of the conventional aluminum wire strand having a steel core. When a high-strength and low-thermal-expansion wire is utilized as a core material of an aluminum wire strand, a plurality of material wires must be bundled. In order to evaluate performances of the wire bundling or twisting working, there is conducted a torsion test in which one end of a combination of material wires is fixed and the other end is twisted, so that the performances will be evaluated by torsional values.

Fe—Ni system alloys for this purpose are disclosed, for example, in JP-B2-56-45990, JP-A-55-41928, JP-B2-57-17942, JP-A-55-122855, JP-A-55-128565, JP-A-55-131155, JP-A-56-142851, JP-A-57-26144, JP-A-58-11767 and JP-A-58-11768, which have been suggested to improve strength and torsional property. Further, in order to improve strength and torsional property of those alloys, there have been suggested high-strength and low-thermal-expansion alloy wires (ACIR wires) and manufacturing methods of alloy wires disclosed in JP-B2-60-34613, JP-B2-2-15606, JP-B2-2-41577 and JP-B2-2-55495.

Any of the above-mentioned conventional high-strength and low-thermal-expansion alloy has a composition of Ni, or Ni and Co in a range of 35 to 50%, interstitial type solid-solution strengthening elements such as C (carbon) and N (nitrogen), several kinds of substitution type solid-solution strengthening elements such as Cr and Mo, and several kinds of precipitation hardening elements such as Ti and Nb in such a range as not to deteriorate the low thermal expansion property, and balance of Fe. As subjected to solutioning heat treatment or annealing heat treatment, a favorable torsional property can be obtained from any of the alloys, but tensile strength is, at most, in a range of 50 to 80 kgf/mm$^2$. In such a state, the alloys are unsuitable for use as a core wire of a low sag grade for an overhead power-transmission line. Any of the alloys has a work hardening capacity is larger than those of conventional low-thermal-expansion alloys such as a 36% Ni—Fe alloy and a 42% Ni—Fe alloy, and a tensile strength of 100 to 130 kgf/mm$^2$ can be obtained by cold working. Consequently, alloys have been partially put into actual use.

However, most of piano wires employed as core wires of the conventional steel-core aluminum wire strands have strength of 170 kgf/mm$^2$ grade, and low-thermal-expansion alloy wires having tensile strength which is substantially the same as or close to that of the piano wires of 170 kgf/mm$^2$ grade have been required for increasing transmission capacities of the power-transmission lines without rebuilding pylons. Moreover, if the conventional high-strength low-thermal-expansion alloy wires mentioned above are simply subjected to high reduction working in the cold temperature zone, their torsional property which expresses a deforming capacity with respect to torsion will be largely deteriorated. Therefore, not only the above-mentioned alloys but also various kinds of complicated manufacturing methods have been proposed to make tensile strength and torsional property compatible with each other.

For example, in JP-B2-60-34613 and JP-B2- 2-15606, stress relieving annealing is performed at a stage prior to cold working or in the course of cold working in order to attain compatibility of tensile strength and torsional property. Those manufacturing methods discloses that favorable torsional property can be obtained when deformation of the surface caused by scalping is removed by annealing heat treatment.

On the other hand, although JP-B2-2-41577 and JP-B2-2-55495 disclose alloy wires manufactured in substantially the same process as the above-mentioned JP-B2-60-34613 and JP-B2-2-15606, it is stated that carbide of $Mo_2C$ generated during annealing after cold working contributes to improvements of strength and torsional properties. However, one of the inventors of JP-B2-2-41577 and JP-B2-2-55495 mentions an improvement of torsional property in a report titled "Effect of processes of drawing on torsional property of high-tensile strength Invar alloy wire" (Wire Journal International vol. 21. No. 4 (1988), p. 84). The report says that torsional property can not be fully improved merely by performing annealing heat treatment for precipitated $Mo_2C$ after cold working, and that a drawing angle of a die must be decreased so that, particularly in a distribution of hardness in a cross section of alloy wire after drawing, hardness in the center will be the highest, and a special jig called Christopherson tube for enhancing lubricative property is required.

However, the improvement of torsional property by decreasing a drawing angle of a die and using the jig results in an increase in the number of drawing passes (a ratio of a decrease in a cross-sectional area per pass can not be increased when the drawing angle is decreased). Also, it takes time to change the process in the manufacturing line. Consequently, this manufacturing method is extremely inefficient for manufacturing an alloy wire having an entire length of several kilometers.

Taking the above problems into account, the present invention has been proposed.

SUMMARY OF THE INVENTION

An objective of the invention resides in providing a high-strength low-thermal-expansion wire which has a tensile strength one grade higher than that of the conventional Fe—Ni high-strength low-thermal-expansion wire, i.e., a tensile strength equal to that of a piano wire, and which has a constantly high torsional property without complicated processes, and providing a manufacturing method of the same.

The present inventors investigated tensile properties, torsional properties and thermal expansion coefficients of alloy wires which were made of hot rolled materials of alloys having compositions in which various alloying elements were added to Fe—Co—Ni alloy system. As a result, it was understood that the work hardening capacity of the conventional Fe—Ni alloy wire having high-strength and low-thermal-expansion is limited because austenite phase is stable even if it is subjected to high-reduction cold working, so that the strength as high as that of the piano wire can not be obtained. Thus, it was found that in order to obtain a wire having high strength and low thermal expansion at the level intended by the present invention, such an alloy composition that austenite phase is partially transformed into martensite phase by high-reduction cold working is selected, and further, the alloy composition before the cold working is made the most suitable for obtaining the lowest coefficient of thermal expansion, thereby enabling the compatibility of high strength and low thermal expansion property.

A basic alloy for obtaining such high-strength and low-thermal-expansion properties consists of 0.06 to 0.50% C (carbon), 25 to 65% in total of one or both of not more than 65% Co and less than 30% Ni, and balance of Fe as a main component, other optimal elements and unavoidable impurities. To the above composition, alloying, elements such as Si, Mn, Cr, W, Mo, B, Mg and Ca can be further added to improve and stabilize strength and thermal-expansion properties. Moreover, it is permissible for the alloy to contain appropriate amounts of primary-carbide generating elements such as V, Ti, Nb, Ta, Hf and Zr so as not to deteriorate performances of high-strength and low-thermal-expansion wire according to the present invention although positive addition of those elements of V, Ti and so on is not preferable.

It was also found that when high-strength and low-thermal-expansion wire which has the above-described capacity of transformation induced by working is to be used as a core wire for a heat resistant power-transmission line of a low sag grade, a complicated annealing treatment need not be carried out during the normal cold drawing process, especially in the course of it after hot working, and that a torsional value at substantially the same level as that of the conventional piano wire can be obtained and made stable merely by performing a simple cold drawing. It was thus understood that the manufacturing method is particularly suitable for obtaining a core wire for a power-transmission line.

Although the capacity of transformation induced by working is sensitive to a change in the alloy composition, the induced transformation capacity can be stabilized by performing heat treatment for controlling it, after hot rolling or in a cold drawing process after hot rolling. Consequently, even if the composition is somewhat changed, there will not be large changes in strength and torsional property under the conditions that the reduction rate of cold working in the subsequent process is constant, thereby enabling production of a core wire for a heat resistant power-transmission line of a low sag grade. The stabilization of the induced transformation capacity can be systematically controlled by causing carbides of alloying elements such as Fe, Cr, W and Mo to dissolve into matrix or to precipitate during heat treatment for controlling the induced transformation capacity.

It was also found that both strength and ductility of the high-strength and low-thermal-expansion wire containing martensite phase induced by working after cold working can be improved by aging treatment at the time of finishing. The mechanism of strength and ductility improvement by the aging treatment has not been clear at present. However, there can be suggested such causes as strain aging, aging due to precipitation of carbides, and aging due to reverse transformation of martensite phase produced by transformation induced by working, into austenite phase.

More specifically, according to the present invention, there is provided a wire of high strength and low thermal expansion made of an alloy material consisting of, by weight, 0.06 to 0.50% C (carbon), at least one of not more than 65% Co and less than 30% Ni in total amount of 25 to 65% of "Co and Ni", and the balance being Fe as a main component, other optional elements and unavoidable impurities, and having a primary phase of austenite and a further phase of martensite induced by working.

More preferably, the alloy of high strength and low thermal expansion comprising, by weight, 0.06 to 0.50% C, up to 1.5% Si, up to 3% Mn, 2 to 65% Co and up to 30% Ni, Co and Ni satisfying the following formula:

$$52-(5\ Ni/3) \leqq Co \leqq 65-(5\ Ni/3),$$

up to 11% Cr, up to 6% W and up to 6% Mo in a range which satisfies the following formula:

$$5-(Ni/4) \leqq Cr+0.54\ Mo+0.28\ W \leqq 11-(Ni/4),$$

and the balance being essentially Fe except for unavoidable impurities.

The alloy of high strength and low thermal expansion may optionally comprises one or more of 0.0001 to 0.02% B (boron), 0.0001 to 0.02% Mg and 0.0001 to 0.02% Ca, and not more than 1.0% in total of one or more of V, Ti, Nb, Ta, Hf and Zr, in place of a part of Fe. The alloy further optionally comprises one or both of 0.001 to 0.2% Al and 0.001 to 0.2% REM in place of a part of Fe.

A preferable rate of martensite induced by working in the alloy of high-strength and low-thermal-expansion is 2 to 35%.

It is desirable that a high-strength and low-thermal-expansion alloy wire made from the alloy of the composition and the martensite rate described above has 150 kgf/mm$^2$ or greater of tensile strength at normal temperature, not greater than $6\times10^{-6}$/° C. of the average thermal expansion coefficient at from normal temperature to 230° C., 15 times or more of the torsional value when the grip interval is 100 times as large as the diameter of the wire and not greater than 3 $\mu$m of the surface roughness in terms of the maximum height (Rmax). However, all of the above properties need not necessarily to-be satisfied at once. It is acceptable that one or more of the properties are satisfied in accordance with conditions under which the alloy wire is used.

According to a method of manufacturing an alloy wire of high strength and low thermal expansion, the wire having a composition according to any one of Claims 1 to 11 is subjected to cold working so that austenite phase is partially transformed into martensite phase induced by working. The manufacturing method can be applied to all of the high-strength and low-thermal-expansion alloy wires having the alloy compositions according to the invention disclosed above. Therefore, it can be broadly applied to a wire material containing solid-solution strengthening elements in addition to the main components, a wire material containing precipitation hardening elements, and so forth.

In the method according to the present invention, preferably, a heat treatment for controlling the capacity of transformation induced by working in a temperature range of 500° C. to 1200° C. should be carried out after hot rolling or in the course of cold working after hot rolling, and thereafter, cold working should be further carried out. After the final cold working, an aging treatment in a temperature range of 200° C. to 650° C. be preferably performed. The high-strength and low-thermal-expansion alloy wire is also preferably cooled down by cooling means before and after cold working or either before or after cold working so that at least the temperature of the high-strength and low-thermal-expansion alloy wire just before cold working will be not higher than 100° C. Especially when the amount of transformation is to be increased, the working temperature can be controlled to be lower than the room temperature. The above-described preferable manufacturing methods of the high-strength and low-thermal-expansion alloy wire can be properly selected as occasion demands.

A key aspect of the invention alloy wire is that it includes martensite phase induced by working.

Fe—Ni system or Fe—Co—Ni system low-thermal-expansion wires which have been conventionally proposed as a drawing wire for a heat resistant cable of a low sag grade have characteristics in their compositions and manufacturing methods so as to improve the strength, the torsional property and so forth. However, any of those wires has characteristics that austenite phase occupies the most part of structure.

Even if the invention alloy wire is rapidly cooled after hot working or solutioning heat treatment, austenite phase is stable as a primary phase at normal temperature. However, during drawing process, transformation is caused by cold working of high reduction, thereby inducing martensite transformation. As well as addition of carbon for increasing the work hardening capacity of austenite matrix, the martensite transformation takes large effects in hardening by cold working.

When a high-strength low-thermal-expansion material of the present invention is processed into a wire material, a constant torsional value of about 40 times can be obtained even if annealing is not performed especially in an intermediate process in a cold drawing process. This level of the torsional value is equal to the level of the torsional value of the conventional piano wire. This is presumably because of martensite phase induced by working which has already existed as a result of cold working or a decrease in stress owing to transformation of austenite phase into martensite phase during twisting.

When austenite phase of matrix of Invar alloy is stable even if it is subjected to high reduction cold working, the thermal expansion coefficient is low but tensile strength is insufficient. When a wire material is subjected to cold working, an inadequate torsional property is obtained from a mere cold drawing process. In contrast, when austenite phase is too unstable, martensite transformation is caused excessively after hot working or in a cooling process after solutioning treatment, so that the Invar properties can be no longer obtained. For the above-described reasons, in order to obtain a high strength, a low coefficient of thermal expansion and a high torsional value at once, the invention wire must have two phases, i.e., austenite and martensite phases generated by transformation induced by working.

In respect of matching between strength and low thermal expansion property, however, the rate of martensite generated by transformation induced by working should preferably be not more than 35% in terms of a rate of martensite amount/(martensite+austenite amount) which is derived by the X-ray diffraction method. Martensite induced by working can be partially substituted by thermal martensite transformation induced by quenching treatment in alcohol (about −75° C.) containing dry ice or at a lower temperature. Taking account of dispersion in the transformation rate and the productivity, however, it is more favorable in manufacturing to utilize transformation caused by work strain.

A reverse transformation temperature of martensite induced by working into austenite is not lower than 550° C. Consequently, the high-strength and low-thermal-expansion wire of the present invention has no problems in the properties with respect to continuous use at about 300° C. which is said to be the maximum temperature when it is used as a power-transmission line.

In some cases, martensite induced by working may be partially resolved into carbide and ferrite by heating at 400° C. to 500° C., such as in aluminizing treatment and galvanizing treatment in intermediate and finishing processes of producing the wire as a power-transmission line. However, presence of a small amount of ferrite in the invention wire has no problems in properties.

The wire alloy of the invention is preferred for the following reasons.

Carbon is an element which most effectively contributes to work hardening of austenite phase during cold-working of the high-strength and low-thermal-expansion wire and improvement of strength of martensite phase induced by working, and is the most notable alloying element in the manufacturing method of the wire. Further, as an austenite stabilizing element, carbon can substitute part of Ni and Co. The lower limitation of carbon is 0.06%. On the other hand, C (carbon) exceeding 0.50% stabilizes the austenitic phase excessively, thereby impeding martensite transformation and also inducing an increase in the thermal expansion coefficient. Therefore, carbon is limited to 0.06 to 0.50%. The preferable range of carbon is 0.15 to 0.50% and, more preferably, 0.15 to 0.40%.

Silicon and manganese are included in the invention alloy as deoxidizing elements. Since excessive Si and Mn increase the thermal expansion coefficient, Si and Mn are limited to up to 1.5% and up to 3%, respectively. More preferably, the ranges of Si and Mn are up to 0.5% and up to 1%, respectively.

In the alloy of invention wire, Co and Ni are alloying elements required for providing properties of Invar alloy for the alloy as well as Fe of the balance. When the invention alloy contains one or both of up to 65% Co and up to 30% Ni, 25 to 65% in total amount of Ni and Co, an Fe—Ni—Co—C alloy system or an Fe—Ni—Co—C alloy system to which elements such as Si, Mn, Cr, W, Mo, B (boron), Mg and Ca are further added is selected to obtain an alloy wire having a desirable capacity of transformation induced by working. Particularly, an optimum compatibility between low thermal expansion property and high strength is attained under a specific relationship between Ni and Co content with relation to contents of Cr, Mo and W that contents of Ni and Co, which one referred to as (Ni, Co) in a co-cordinate of Ni—Co shown in FIG. 1, are selected within a lozenge-shaped defined by four points (30, 2), (30, 15), (0, 65) and (0, 52). The favorable area of the invention and an area A at the upper right side of the invention area are divided by a formula of Co=65−(5 Ni/3). When an alloy has a composition in the area A, austenite phase of the alloy is considerably stable even if it is subjected to high-reduction cold working. By selecting the most suitable composition in the area A, the thermal expansion coefficient can be sufficiently lowered but tensile strength is not enough. On the other hand, the favorable area of the invention and an area B of the lower left side of the invention area are divided by a formula of Co=52−(5 Ni/3). When an alloy has a composition in the area B, stable austenite phase is difficult to be present at a normal temperature before cold working, and martensite phase is easily generated to lose low thermal expansion property.

Thus, the favorable ranges of Ni and Co of the invention alloy are, as shown in FIG. 1, 25 to 65% in total of one or both of up to 65% Co and up to 30% Ni. More favorably, the alloy contains 2 to 65% Co and up to 30% Ni satisfying the following formula:

$$52-(5\ Ni/3) \leqq Co \leqq 65-(5\ Ni/3) \quad (1)$$

In view of production cost and stability of the quantity, the preferable ranges of Ni and Co satisfy not only the formula 1 but also (Ni, Co)=(12 to 30, 8 to 32) and, more preferably (Ni, Co)=(18 to 30, 8 to 22) and, further preferably (Ni, Co)=(21 to 29.5, 8 to 17).

Chromium, molybdenum and tungsten are alloying elements in the same group and serve to stabilize austenite phase of matrix. Also, they enhance the work hardening capacity of matrix as solid-solution strengthening elements and partially as precipitation hardening elements of carbide. Thus, Cr, Mo and W can be added solely or in combination as occasion demands. Those alloying elements further serve to increase high-temperature strength at about 300° C. of highest temperature in use of heat resistant power-transmission lines of a low sag grade. However, all of those are elements of lowering the transition temperature. Hence, when Cr, Mo and W contents exceed 11%, 6%, and 6%, respectively, the transition temperature is lowered excessively, thereby drastically increasing the thermal expansion coefficient at 200° C. to 300° C. Thus, the upper limit of Cr is 10%, Mo 6%, and W 6%. Moreover, those elements have as solid-solution strengthening and precipitation hardening effects similarly at atomic ratios, which abilities are the same as one another in the same atomic ratio, hence it is also necessary to specify the upper limit of the sum of "Cr+0.54 Mo+0.28 W".

Amount of "Cr+0.54 Mo+0.28 W" serves to adjust the transition temperature of Fe—Co—Ni. Higher the amount is in a low-Ni and high-Co area, or lower the amount is in a high-Ni and low-Co area, more suitable low-thermal-expansion property and stability of austenite phase are compatible with each other. When the relationship is expressed in the form of a function of Ni amount, the amount of "Cr+0.54 Mo+0.28 W" is preferably determined by the following formula:

$$5-(Ni/4) \leqq Cr+0.54\ Mo+0.28\ W \leqq 11-(Ni/4) \quad (2)$$

The area indicated by the formula 2 means that Ni content is up to 30%, and that the point (Ni, "Cr+0.54 Mo+0.28 W") in a coordinate of Ni and "Cr+0.54 Mo+0.28 W" exists within an area defined by five points (30, 0), (30, 3.5), (0, 11), (0, 5) and (20, 0).

When the point of (Ni, "Cr+0.54 Mo+0.28 W") is in an area C, austenite phase is considerably stable even if it is subjected ot high-reduction cold working, so that tensile strength will be insufficient, and that the coefficient of thermal expansion will be increased. On the other hand, when the point of (Ni, "Cr+0.54 Mo+0.28 W") is in an area D, stable austenite phase is difficult to be present at a normal temperature before cold working, and martensite phase is easily generated to lose low thermal expansion property.

In the high-Ni and low-Co area which is favorable in view of production cost and stability of the quality the upper limit of an additive amount of each of Cr, Mo and W must of course be decreased in accordance with the formula 2. When (Ni, Co) is (12 to 30, 2 to 32), a favorable range of (Cr, Mo, W) is (up to 8, up to 6, up to 6). When (Ni, Co) is (18 to 30, 2 to 22), (Cr, Mo, W) is (up to 6.5, up to 5, up to 5). When (Ni, Co) is (21 to 29.5, 6.5 to 17), (Cr, Mo, W) is (up to 5.75, up to 4, up to 4). Especially when (Ni, Co) is (21 to 29.5, 6.5 to 17), Cr, Mo and W need not be added to obtain an optimum balance between tensile strength at normal temperature and low thermal expansion property.

Boron segregates on austenite crystal grain boundaries and strengthens the grain boundaries, thus serving to improve hot workability of the invention alloy and to improve ductility at normal temperature. Mg and Ca combine with sulfur to generate granular sulfide. Like as B, Mg and Ca serve to improve hot workability and ductility at normal temperature. IN order to obtain such effects, one or more of B, Mg and Ca can be added in each content of not less than 0.0001%. However, excessive addition of more than 0.02% of any of those elements lowers the fusing point of the alloy and unfavorably deteriorates hot workability. Thus, the amount of any of B, Mg and Ca should be 0.001 to not more than 0.02%.

V, Ti, Nb, Ta, Hf, Zr and the like are equivalent to C, Cr and Mo in effects of solid-solution strengthening and precipitation hardening of fine MC type carbide. The former group can be added as elements for strengthening an Fe—Ni—Co alloy, and combine with carbon to generate fine primary carbide, so that austenite phase is hardened by precipitation of the carbides. Also, the former group elements dissolve into matrix so as to enhance the work hardening capacity of the alloy during cold working. With respect to those effects, one or more of V, Ti, Nb, Ta, Hf and Zr can be added as occasion demands. The effects are obtained by addition of a slight amount of about 0.001% or more of the alloying elements into the alloy. However, if the sum of the elements by weight % exceeds 1% in total, coarse primary carbides precipitate so that voids tend to generate in the vicinity of the carbides during cold drawing, thereby causing a dispersion in torsional property. Further, an increase of the coefficient of thermal expansion is greater than effect of strength improvement. Thus, total amount of 0.001 to 1% of one or more of V, Ti, Nb, Ta, Hf and Zr should be added.

Al and REM can be added for deoxidization and desulfurization. Each of Al and REM is effective even from a slight amount. However, excessive amount of the elements cause the alloy difficult to melt, so that the upper limit of each of Al and REM is not more than 0.2%.

Gas components such as oxygen and nitrogen generate non-metallic inclusions in the alloy and cause a dispersion in the torsional value. Thus, content of each of oxygen and nitrogen in the alloy is desirably not more than 0.01%.

The alloy according to the present invention is a high-strength and low-thermal-expansion alloy consisting essentially of the above-mentioned alloying elements and balance of Fe.

The rate of martensite induced by working in the alloy is preferably 2 to 35%. If the rate of martensite induced by working is less than 2%, the intended strength can not be obtained. On the other hand, if the transformation rate of martensite induced by working increases too much and exceeds 35%, the coefficient of thermal expansion becomes too high so that the intended low thermal expansion property can be obtained. Herein, the rate of martensite induced by working is defined by an intensity ratio of martensite phase to the sum of martensite and austenite phases of texture, which are determined by X-ray diffraction of a cross section of a worked wire. Transformation from austenite to martensite phase induced by working proceeds in a process of a growth of $\gamma$ (111) and subsequent a growth of $\alpha$ (110).

Reasons for restricting favorable property values and surface roughness of the high-strength and low-thermal-expansion alloy wire of the invention will now be described.

Tensile strength of the alloy wire invention is limited to a value of not less than 150 kgf/mm$^2$ in a tensile test at normal temperature. In the case where the tensile strength is not less than 150 kgf/mm$^2$, in use, it is capable of utilizing the designed strength of piano wire which has conventionally been used as a core wire of an overhead heat resistant power-transmission line. Thus power-transmission lines can be exchanged without rebuilding pylons, and it becomes possible to increase the transmission capacity due to a lower sag grade.

The coefficient of thermal expansion of the alloy wire is limited to a range of not greater $6\times10^{-6}$/° C. in a temperature range of from a normal temperature to 230° C. The upper limitation of the temperature range is determined on the basis of that the highest temperature in normal use of heat resistant Al alloy wire for transmission of electric power is 230° C. When the coefficient of thermal expansion in the temperature range is not greater than $6\times10^{-6}$/° C., it becomes possible to perform power transmission of a capacity about twice as large as that of a conventional aluminum wire strand having a steel core (ACSR wire) of conventional piano wire.

The torsional property of the alloy wire is limited to 15 times or more in terms of a torsional value when the grip interval is 100 times as large as the diameter of the wire. If the torsional value is less than 15 times, there is a possibility that the core wire will break during a stranding operation of the core wire whose entire length is several kilometers.

With the conventional high-strength and low-thermal-expansion alloy wire mainly comprising austenite phase, it has been impossible to satisfy, simultaneously, strength and low thermal expansion property, strength and torsional property, and the strength, low thermal expansion property and torsional property. However, by selecting the composition of the alloy in which austenite phase is changed to be more unstable and is partially transformed into induced martensite phase during cold working, strength and low thermal expansion property, strength and torsional property, and strength, low thermal expansion property and torsional property can be satisfied simultaneously.

Moreover, by making the surface of the high-strength and low-thermal-expansion alloy wire as smooth as possible, stress concentration on the surface is prevented in a torsion test, thereby suppressing a dispersion of the torsional value so that an average value of the tosional value increases. The surface roughness of an ordinary low-thermal-expansion alloy wire is about 4 to 10 $\mu$m in terms of the maximum height (Rmax) defined in JIS B0601. By making this surface roughnessnot greater than 3 $\mu$m, torsional property can be improved in comparison with the low-thermal-expansion alloy wire having the surface roughness at a normal-expansion alloy wire having the surface roughness at a normal level. As to a manufacturing method for making the surface roughness not greater than 3 $\mu$m, it is effective to use a wet lubricant during final cold working of the alloy wire.

Next, the manufacturing method of the invention alloy wire will be described with regard to same conditions.

As described before, the invention alloy wire must be subjected to high-reduction cold working to make low thermal expansion property and high strength compatible with each other. A reduction rate of cold working which is required for obtaining the properties of the invention alloy wire can not be definitely determined because it is influenced by the alloy composition and temperature of cold working. Preferably, however, the reduction rate should be controlled so that the martensite rate after cold working will be not greater than 35%.

Moreover, the alloy wire having the above-mentioned capacity of transformation induced by working need not be subjected to complicated annealing process during normal cold drawing process after hot working and especially between the cold drawing process. By merely subjecting the alloy wire to simple cold drawing process, the torsional value at the same level as that of the conventional piano wire can be obtained. Presumably, this is largely because of an inclueence of stress lessened by transformation induced by working from austenite phase to martensite phase during torsional deformation. A key aspect of the invention manufacturing method is that high strength and high torsional property can be made compatible without annealing process between cold working.

Further, when the invention alloy wire is subjected ot a heat treatment for controlling the capacity of transformation induced by working after hot rolling or during cold working after hot rolling, a high-strength low-thermal-expansion alloy wire having stabler properties can be produced. The induced transformation capacity is sensitive to a difference in the alloy composition. However, the induced transformation capacity can be stabilized by performing this heat treatment for controlling it. Consequently, even if there is some change in the composition, strength and torsional property will not be largely changed under the conditions that the reduction rate of cold working in the subsequent process is constant, thereby enabling the manufacture of a heat resistant core wire of a low sag grade for a power-transmission line. This stabilization of the capacity of transformation induced by working can be systematically controlled by dissolving or precipitating carbide of alloying elements such as Fe, Cr, W and Mo during heat treatment for controlling the transformation capacity.

When a temperature of the controlling heat treatment is lower than 500° C., diffusion of various kinds of elements will be insufficient so that control of the induced transformation capacity can not be adequately performed. On the other hand, when the temperature of the controlling heat treatment exceeds 1200° C., sufficient solid solution of carbide can be obtained. However, coarsening of crystal grains, oxidization of the surface and decarburization will be remarkably found, thereby making unstable the quality of high-strength low-thermal-expansion alloy wires. Therefore, the heat treatment for controlling the induced transformation capacity after hot rolling or during cold working after hot rolling is limited to a temperature range of 500° C. to 1200° C. As for retention time of the controlling heat treatment, the control effect can be produced even by heating for a short time if the whole alloy wire is uniformly heated. Besides, the controlling heat treatment can be substituted by warm working or hot working for the second time in the course of cold drawing.

Further, when the high-strength and low-thermal-expansion alloy wire including martensite phase induced by working which has been obtained through cold working is subjected to aging treatment in finishing process, not only strength but also ductility can be improved. The mechanism of strength and ductility improvement by aging treatment is not necessarily clear at present. However, it is supposed that such causes as strain aging aging due to precipitation of carbides, and aging due to reverse transformation of martensite phase, produced by transformation induced by working, into austenite phase. Also, the aging treatment serves as a recovery treatment of the thermal expansion coefficient of the alloy wire. However, when a temperature of aging treatment is lower than 200° C., an enough effect of aging can not be attained. On the other hand, when the aging treatment temperature is higher than 650° C., the alloy wire will be softer than the level intended by the invention. Thus, a temperature range of the aging treatment is limited to 200° C. to 650° C.

In the manufacturing method, a temperature of cold working with an ordinary continuous drawing machine is generally about 150° C. due to generation of working (or deforming) heat. For the invention alloy wire, it is important to make cold working temperature as low as possible and keep it constant, so as to stabilize production during drawing working. Thus, in order to stabilize the transformation capacity, it is also important that at least the temperature of the alloy wire just before cold working is made not higher than 100° C., for example, by cooling a take-up drum by water or by spraying cooling water both sides or one side of drawing dies in the case of continuous drawing working.

As a method of cold working of the invention alloy wire, there are generally known drawing with dies or rolls, rolling with rolls, swaging and so forth. Scalping treatment and pickling treatment can be performed as occasion demands in order to remove facial defects of the alloy wire generated by hot working, the heat treatment for controlling the transformation capacity, and so forth. Scalping and pickling treatments will not at all deteriorate properties of the alloy wire.

The invention alloy is manufactured by melting an alloy of the above-described chemical composition. As a melting method, either melting in the atmosphere or vacuum melting can be employed. Especially, in order to control the capacity of transformation induced by working, it is effective to employ electro-slug remelting or vacuum arc remelting, which is highly efficient in refining and reducing segregation.

In addition to the above-described alloy wire, the invention alloy can be applied to products in all fields which require tensile strength and low thermal expansion property which can be achieved by the present invention, so long as their applications and configurations are such that cold working can be performed. Moreover, products of the invention alloy whose strength is enhanced by partial cold working can be manufactured.

BRIEF DESCRIPTION OF THE DRAWING

FIG. 1 is a diagram showing relationships between Ni and Co, and Ni and "Cr+0.54 Mo+0.28 W" in chemical compositions of the invention alloy and conventional alloys.

EXAMPLE

Fe—Co—(Ni—(Cr+Mo+W)) system alloys having composition shown in Table 1 were melted into ingots, and the ingots were subjected to hot working to prepare round bars having diameter of 13.0 to 15.0 mm. Thereafter, or in the course of cold drawing after that, the bars were subjected to a heat treatment for controlling the transformation capacity in which they were maintained at various temperatures for one hour and then cooled by water. Facial scalping was conducted after this controlling heat treatment. Next, the bars were subjected to cold drawing to prepare coils having diameter of 4.9 to 2.5 mm at various reduction rates. Further, the coils were partially subjected to aging treatment in which they were maintained at various temperatures for two hours and then cooled in air. Various properties of the coils were evaluated. As to a wire of an alloy No. 8 alone, the controlling heat treatment was not conducted, and facial scalping was performed after hot working. Thereafter, the alloy No. 8 was subjected to cold drawing to produce a coil wire having a diameter of 4.6 mm.

Conditions of producing the alloy wires are shown in Table 2 in detail. In Table 2, abbreviations W1, H1, W2 and H2 respectively denote a reduction rate of cold working until H1 after hot rolling, a temperature of the heat treatment for controlling the capacity of transformation induced by working (kept for one hour), a reduction rate of cold working after H1, and a temperature of the aging treatment (kept for two hours). Temperatures of the wire samples just before the final three passes are shown in the column of Working Temperature, and kinds of lubricants used for final drawing dies are shown in the column of Lubricant.

For cold drawing, dies made of WC having a quite common approach angle of 12° were used. The cold drawing was performed at a reduction ratio of about 20% per pass. The drawing speed at the time was substantially equal to an ordinary speed of drawing of a steel wire. With the wire samples kept unchanged in the conditions after the final process, measurement of surface roughnesses, tensile tests, torsional tests, winding and unwinding tests, thermal expansion tests and measurement of martensite rates in the wire samples were performed. The results are also shown in Table 2.

As for the surface roughness, maximum heights (Rmax) based on JIS B0601 were measured. Elongations in the tensile tests were measured in the form of a total elongation of elastic and plastic elongations at 250 mm of gauge length, and an average value of five coils was obtained for each sample as well as the tensile strength. In the torsional tests, a grip interval was made 100 times as long as a diameter of each wire itself, and the tests were conducted at a rotational speed of 60 rpm. Torsional values of ten coils until rupture were measured for each sample, and an average value of them was obtained. In the winding and unwinding tests, it was investigated whether each test sample was ruptured or not when it was wound and unwound on a core wire eight times, the core wire having a diameter which is 1.5 times as long as the diameter of the sample itself. The coefficient of thermal expansion was measured by a differential dilatometer to obtain an average thermal expansion coefficient from 30° C. to 230° C. As for the martensite rate, X-ray diffraction of a cross section of each low-thermal-coefficient wire was performed, and a martensite rate of each sample was derived from the following formulas:

$$\text{Martensite phase } (\%)=(Ia/(I\gamma+I\alpha))\times 100$$

$Ia=I\alpha\ (110)+I\alpha\ (200)+I\alpha\ (220)+I\alpha\ (211)$

*Note: $I\alpha$ (110), $I\alpha$ (200), $I\alpha$ (220) and Ia (211) are intensities of martensite in X-ray diffraction.

$I\gamma=I\gamma\ (111)+I\gamma\ (200)+I\gamma\ (220)+I\gamma\ (311)$

*Note: $I\gamma$ (111), $I\gamma$ (200), $I\gamma$ (220) and $I\gamma$ (311) are intensities of austenite in X-ray diffraction.

Of the aloys shown in Table 1, Nos. 1 to 38 are invention alloys, and No. 41 is a conventional high-strength low-thermal-expansion alloy disclosed in JP-A-3-115543. Relationships between Ni and Co and those between Ni and "Cr+0.54 Mo+0.28 W" of the samples Nos. 1 to 38 and 41 are also shown in table 1.

It is understood from Table 2 that under various manufacturing conditions, the invention alloy wires can have tensile strengths of 150 to 210 kgf/mm$^2$ and thermal expansion coefficients of not greater than $6.0\times10^{-6}$/° C., and that tensile strengths which substantially equal to or close to that of the conventional piano wire and thermal expansion coefficients which are ½ or less of that of the piano wire can be obtained (the thermal expansion coefficient of the piano wire $\alpha$ 30–230° C. (11.5 to $13\times10^{-6}$/° C.). When those properties are compared with those of a conventional Fe—Ni high-strength low-thermal-expansion wire, e.g., the conventional alloy No. 41, the thermal expansion coefficent is somewhat inferior, but the tensile strength is higher by a considerable degree. In order to extend power-transmission lines again without rebuilding the existing pylons, it is essential for the wire to have substantially the same strength as the piano wire. Therefore, the invention alloy wires are somewhat inferior to the conventional Fe—Ni high-strength low-thermal-expansion wire in respect of the relaxation grade, but they are by far superior to the conventional Fe—Ni high-strength and low-thermal-expansion wire in respect of the strength.

Further, it is understood from Table 2 that the invention alloy wires have high torsional values and excellent winding and unwinding properties. The effects can be attained by martensite induced by working which is generated during cold working, and by transformation of austenite phase to martensite phase which is caused during plastic deformation in various kinds of the above tests. It is understood from Table 2 that the invention alloy wires constant of 4 to 33% martensite phase and the balance which is essentially austenite phase (to be exact, a small amount of carbide exists as the third phase in many cases, and also, partially quenched martensite may exist in some cases after the heat treatment for controlling the transformation capacity).

TABLE 1

| | | Chemical composition (wt. %) | | | | | | | | | | |
|---|---|---|---|---|---|---|---|---|---|---|---|---|
| | No. | C | Si | Mn | Ni | Co | Cr | Mo | W | Fe | B | Mg |
| Invention alloy | 1 | 0.25 | 0.13 | 0.24 | 28.2 | 12.5 | — | — | — | Bal | 0.001 | 0.005 |
| | 2 | 0.23 | 0.33 | 0.17 | 27.5 | 8.4 | — | 2.40 | — | Bal | 0.002 | — |
| | 3 | 0.19 | 0.22 | 1.04 | — | 55.0 | 9.23 | — | — | Bal | 0.001 | 0.002 |
| | 4 | 0.35 | 0.23 | 0.23 | — | 54.8 | 7.22 | 1.90 | 1.80 | Bal | — | — |
| | 5 | 0.15 | 0.13 | 0.17 | 10.2 | 37.0 | 6.23 | — | 3.02 | Bal | — | — |
| | 6 | 0.41 | 0.18 | 0.18 | 9.8 | 37.8 | 4.73 | 2.03 | — | Bal | — | 0.005 |
| | 7 | 0.26 | 0.16 | 0.24 | 9.8 | 38.0 | 6.81 | — | — | Bal | 0.004 | — |
| | 8 | 0.09 | 0.19 | 1.54 | 20.3 | 22.9 | 4.41 | — | — | Bal | 0.002 | 0.003 |
| | 9 | 0.26 | 0.23 | 0.23 | 19.9 | 23.7 | 4.48 | — | — | Bal | 0.002 | 0.004 |
| | 10 | 0.25 | 0.23 | 0.23 | 19.0 | 22.7 | 4.40 | — | — | Bal | — | — |
| | 11 | 0.26 | 0.17 | 0.21 | 20.4 | 22.8 | 3.42 | — | — | Bal | — | 0.003 |
| | 12 | 0.27 | 0.18 | 0.18 | 29.5 | 6.5 | — | — | — | Bal | — | — |
| | 13 | 0.28 | 0.17 | 0.18 | 28.4 | 6.5 | — | — | — | Bal | 0.002 | 0.001 |
| | 14 | 0.26 | 0.16 | 0.21 | 28.5 | 6.5 | — | — | 3.61 | Bal | 0.002 | 0.001 |
| | 15 | 0.26 | 0.23 | 0.23 | 28.6 | 7.6 | 0.40 | 1.34 | — | Bal | 0.002 | 0.003 |
| | 16 | 0.25 | 0.42 | 0.14 | 28.2 | 15.0 | — | — | — | Bal | 0.002 | — |
| | 17 | 0.10 | 0.14 | 0.24 | 29.2 | 12.7 | — | — | 0.43 | Bal | — | — |
| | 18 | 0.16 | 0.23 | 0.34 | 26.5 | 19.2 | — | — | — | Bal | — | — |
| | 19 | 0.37 | 0.41 | 0.93 | — | 53.9 | 7.30 | — | — | Bal | — | — |
| | 20 | 0.26 | 0.21 | 0.13 | 9.9 | 38.9 | 6.72 | — | — | Bal | 0.002 | 0.003 |
| | 21 | 0.26 | 0.07 | 0.06 | 27.8 | 8.7 | — | 2.60 | — | Bal | — | — |
| | 22 | 0.26 | 0.06 | 1.22 | 20.0 | 22.4 | 3.60 | — | — | Bal | 0.002 | — |
| | 23 | 0.37 | 0.44 | 0.89 | — | 53.9 | 7.00 | — | 1.00 | Bal | — | 0.003 |
| | 24 | 0.25 | 0.19 | 0.21 | 9.8 | 39.0 | 6.20 | — | 1.41 | Bal | 0.002 | 0.004 |
| | 25 | 0.14 | 0.10 | 0.30 | 19.9 | 23.0 | 2.70 | — | 3.20 | Bal | 0.004 | 0.005 |
| | 26 | 0.18 | 0.08 | 0.42 | 27.0 | 12.5 | — | — | 0.80 | Bal | — | — |
| | 27 | 0.25 | 0.04 | 0.20 | 28.6 | 10.8 | — | — | — | Bal | 0.002 | 0.002 |
| | 28 | 0.24 | 0.05 | 0.20 | 28.5 | 12.4 | — | — | — | Bal | — | — |
| | 29 | 0.25 | 0.45 | 0.20 | 28.1 | 14.9 | — | — | — | Bal | — | 0.003 |
| | 30 | 0.10 | 0.05 | 0.20 | 29.0 | 12.4 | — | — | — | Bal | — | — |
| | 31 | 0.21 | 0.04 | 0.20 | 26.4 | 14.6 | — | 2.40 | — | Bal | 0.006 | — |
| | 32 | 0.25 | 0.07 | 0.25 | 23.8 | 19.5 | 2.27 | — | — | Bal | 0.002 | 0.002 |
| | 33 | 0.15 | 0.14 | 0.34 | 26.5 | 19.0 | — | — | — | Bal | 0.004 | — |
| | 34 | 0.08 | 0.09 | 1.21 | 27.5 | 12.1 | 0.70 | 2.10 | — | Bal | — | — |
| | 35 | 0.41 | 0.11 | 0.25 | 25.2 | 17.1 | — | — | — | Bal | — | 0.002 |
| | 36 | 0.25 | 0.31 | 0.51 | 24.5 | 18.5 | — | — | 2.54 | Bal | — | — |
| | 37 | 0.27 | 0.11 | 0.24 | 24.5 | 18.2 | 0.31 | 0.38 | 0.71 | Bal | — | 0.002 |
| | 38 | 0.14 | 0.21 | 0.51 | 27.2 | 17.0 | — | — | 4.04 | Bal | — | — |
| Conventional alloy | 41 | 0.25 | 0.20 | 0.20 | 37.3 | — | — | 2.50 | — | Bal | 0.002 | — |

| | | Chemical composition (wt. %) | | | | | | | | | Cr + 0.54 |
|---|---|---|---|---|---|---|---|---|---|---|---|
| | 1 | Ca | V | Ti | Nb | Ta | Hf | Zr | Al | REM | Mo + 0.28 W |
| Invention alloy | 1 | — | — | — | — | — | — | — | — | — | 0.00 |
| | 2 | 0.003 | — | — | — | — | — | — | — | — | 1.30 |
| | 3 | — | — | — | — | — | — | — | — | — | 9.23 |
| | 4 | — | — | 0.20 | — | — | — | — | — | — | 8.75 |
| | 5 | 0.003 | — | — | — | — | — | — | — | — | 7.08 |
| | 6 | — | — | — | — | — | — | — | — | — | 5.83 |
| | 7 | — | 0.10 | — | 0.13 | — | — | 0.09 | — | — | 6.81 |
| | 8 | — | — | — | — | 0.23 | 0.12 | — | — | — | 4.41 |
| | 9 | — | — | 0.23 | — | — | — | 0.14 | — | — | 4.48 |
| | 10 | — | — | — | 0.12 | — | — | — | — | — | 4.40 |
| | 11 | — | — | — | — | — | 0.11 | — | — | — | 3.42 |
| | 12 | — | — | 0.08 | 0.23 | 0.11 | — | 0.14 | — | — | 0.00 |
| | 13 | — | — | — | — | — | — | — | — | — | 0.00 |

TABLE 1-continued

| | | | | | | | | | | | |
|---|---|---|---|---|---|---|---|---|---|---|---|
| | 14 | 0.002 | 0.33 | — | 0.12 | — | — | — | — | — | 1.01 |
| | 15 | — | — | — | — | 0.22 | — | — | — | — | 1.12 |
| | 16 | — | — | — | 0.09 | — | — | — | — | — | 0.00 |
| | 17 | 0.002 | — | — | — | — | — | — | — | — | 0.12 |
| | 18 | — | — | — | — | — | — | — | — | — | 0.00 |
| | 19 | — | 0.70 | — | — | — | — | — | 0.1 | 0.1 | 7.30 |
| | 20 | — | — | — | 0.31 | — | — | — | — | 0.1 | 6.72 |
| | 21 | 0.002 | — | — | 0.31 | — | — | — | 0.1 | — | 1.40 |
| | 22 | 0.002 | — | — | — | — | — | 0.26 | — | — | 3.60 |
| | 23 | — | 0.73 | — | — | — | — | 0.20 | 0.1 | 0.1 | 7.28 |
| | 24 | — | — | — | 0.28 | — | — | — | — | 0.1 | 6.59 |
| | 25 | — | — | — | 0.09 | 0.26 | — | — | — | — | 3.60 |
| | 26 | — | — | — | — | — | — | — | 0.1 | 0.1 | 0.22 |
| | 27 | — | — | — | — | — | — | — | — | — | 0.00 |
| | 28 | — | — | — | — | — | — | — | — | — | 0.00 |
| | 29 | — | — | — | — | — | — | — | — | — | 0.00 |
| | 30 | 0.002 | — | — | — | — | — | — | — | — | 0.00 |
| | 31 | — | — | — | — | — | — | — | — | — | 1.30 |
| | 32 | 0.002 | — | — | — | — | — | — | — | — | 2.27 |
| | 33 | — | — | — | — | — | — | — | — | — | 0.00 |
| | 34 | — | — | — | — | — | — | — | — | — | 1.83 |
| | 35 | 0.002 | — | — | — | — | — | — | — | — | 0.00 |
| | 36 | — | — | — | — | — | — | — | — | — | 0.71 |
| | 37 | — | 0.11 | — | — | — | 0.10 | — | 0.1 | — | 0.71 |
| | 38 | — | — | — | — | — | — | — | 0.1 | — | 1.13 |
| Conventional alloy | 41 | — | — | — | — | — | — | — | — | — | 1.35 |

TABLE 2

| | | | Manufacturing conditions | | | | | | | Surface |
|---|---|---|---|---|---|---|---|---|---|---|
| | Producing method | Alloy No. | $W_1$ (%) | $H_1$ (° C.) | $W_2$ (%) | $H_2$ (° C.) | Working temperature (° C.) | Lubricant | Final diameter (mm) | roughness Rmax (μm |
| Invention alloy wire | 1a | 1 | — | 850 | 85 | 310 | 100 | Dry type | 4.6 | 5 |
| | 1b | 1 | — | 850 | 91 | — | 25 | " | 3.5 | 6 |
| | 1c | 1 | — | 850 | 91 | 310 | 25 | " | 2.5 | 5 |
| | 1d | 1 | — | 850 | 96 | — | 25 | " | 2.5 | 4 |
| | 2a | 2 | — | 980 | 94 | — | 25 | " | 3.0 | 5 |
| | 2b | 2 | — | 980 | 94 | — | 150 | " | 2.6 | 5 |
| | 3a | 3 | 50 | 980 | 80 | — | 25 | " | 4.6 | 6 |
| | 3b | 3 | 50 | 980 | 80 | 550 | 25 | " | 4.6 | 5 |
| | 4a | 4 | 50 | 980 | 80 | — | 25 | " | 4.6 | 4 |
| | 5a | 5 | 29 | 980 | 85 | — | 25 | Wet type | 4.6 | 1.5 |
| | 6a | 6 | 29 | 1150 | 85 | — | 25 | " | 4.6 | 2 |
| | 7a | 7 | 29 | 980 | 85 | — | 25 | " | 4.6 | 2 |
| | 8a | 8 | 90 | — | — | — | 25 | Dry type | 4.6 | 4 |
| | 9a | 9 | 29 | 980 | 94 | — | 25 | " | 3.0 | 5 |
| | 9b | 9 | 29 | 980 | 94 | 600 | 25 | " | 3.0 | 4 |
| | 9c | 9 | 29 | 800 | 94 | — | 25 | Dry type | 3.0 | 5 |
| | 9d | 9 | 29 | 600 | 94 | — | 25 | " | 3.0 | 5 |
| | 10a | 10 | 29 | 980 | 94 | — | 25 | " | 3.0 | 5 |
| | 10b | 10 | 29 | 980 | 94 | 350 | 25 | " | 3.0 | 4 |
| | 11a | 11 | 29 | 980 | 85 | — | 25 | " | 4.6 | 4 |
| | 11b | 11 | 29 | 980 | 85 | — | 25 | Wet type | 4.6 | 1.5 |
| | 12a | 12 | 29 | 750 | 94 | — | 25 | Dry type | 3.0 | 4 |
| | 13a | 13 | 29 | 750 | 94 | — | 25 | " | 4.6 | 4 |
| | 14a | 14 | 29 | 980 | 94 | — | 25 | Wet type | 3.0 | 1.5 |
| | 15a | 15 | 29 | 980 | 94 | — | 25 | " | 3.0 | 2 |
| | 16a | 16 | 29 | 850 | 94 | — | 25 | Dry type | 3.0 | 4 |
| | 17a | 17 | 29 | 850 | 94 | — | 25 | " | 3.0 | 4 |
| | 18a | 19 | 29 | 850 | 94 | — | 25 | " | 3.0 | 4 |
| | 19a | 19 | — | 980 | 86 | — | 25 | " | 4.6 | 4 |
| | 20a | 20 | — | 980 | 86 | — | 25 | " | 4.6 | 4 |
| | 21a | 21 | — | 980 | 86 | — | 25 | " | 4.6 | 4 |
| | 22a | 22 | — | 980 | 86 | — | 25 | " | 4.6 | 4 |
| | 23a | 23 | — | 980 | 86 | — | 25 | " | 4.6 | 4 |
| | 24a | 24 | — | 980 | 86 | — | 25 | " | 4.6 | 5 |
| | 25a | 25 | — | 980 | 86 | — | 25 | " | 4.6 | 4 |
| | 26a | 26 | — | 980 | 86 | — | 25 | " | 4.6 | 4 |
| | 27a | 27 | — | 850 | 88 | — | 25 | " | 4.3 | 4 |
| | 27b | 27 | — | 850 | 88 | 310 | 25 | " | 4.3 | 4 |
| | 28a | 28 | — | 850 | 94 | — | 25 | " | 3.1 | 4 |

TABLE 2-continued

| | | | | | | | | | | |
|---|---|---|---|---|---|---|---|---|---|---|
| | 29a | 29 | — | 850 | 94 | — | 25 | " | 3.1 | 4 |
| | 30a | 30 | — | 850 | 94 | — | 25 | " | 3.1 | 4 |
| | 31a | 31 | — | 980 | 88 | — | 25 | " | 4.3 | 4 |
| | 32a | 32 | — | 920 | 84 | — | 25 | " | 4.9 | 4 |
| | 33a | 33 | — | 850 | 94 | — | 25 | " | 3.1 | 4 |
| | 34a | 34 | — | 980 | 94 | — | 25 | " | 3.1 | 4 |
| | 34b | 34 | — | 980 | 94 | 310 | 25 | Dry type | 3.1 | 4 |
| | 35a | 35 | — | 980 | 88 | — | 25 | " | 4.3 | 4 |
| | 36a | 36 | — | 980 | 88 | — | 25 | " | 4.3 | 4 |
| | 37a | 37 | — | 980 | 88 | — | 25 | " | 4.3 | 4 |
| | 38a | 38 | — | 980 | 88 | — | 25 | " | 4.3 | 4 |
| Conventional wire | 41a | 41 | — | 980 | 90 | — | 25 | Dry type | 4.6 | 4 |

| | | Tensile properties | | | | Thermal expansion | |
|---|---|---|---|---|---|---|---|
| | Producing method | Tensile strength (kgf/mm$^2$) | Elongation (%) | Torsional value | Winding/unwinding | coefficient $\alpha_{20-220}$ ($\times 10^{-6}$/° C.) | Martensite rate (%) |
| Invention alloy wire | 1a | 156.4 | 3.6 | 29 | ○ | 3.36 | 10 |
| | 1b | 178.8 | 3.4 | 44 | ○ | 3.18 | 15 |
| | 1c | 182.3 | 3.6 | 33 | ○ | 4.50 | 14 |
| | 1d | 208.7 | 2.8 | 43 | ○ | 4.45 | 28 |
| | 2a | 164.8 | 3.4 | 22 | ○ | 2.23 | 14 |
| | 2b | 150.4 | 3.1 | 16 | ○ | 2.94 | 5 |
| | 3a | 194.6 | 2.7 | 26 | ○ | 4.78 | 22 |
| | 3b | 211.4 | 2.4 | 24 | ○ | 5.97 | 33 |
| | 4a | 190.5 | 3.0 | 27 | ○ | 5.34 | 20 |
| | 5a | 157.0 | 4.4 | 40 | ○ | 4.51 | 7 |
| | 6a | 184.0 | 4.1 | 37 | ○ | 4.70 | 18 |
| | 7a | 167.1 | 3.8 | 42 | ○ | 4.20 | 13 |
| | 8a | 154.0 | 3.7 | 21 | ○ | 2.44 | 6 |
| | 9a | 151.4 | 3.2 | 24 | ○ | 2.64 | 4 |
| | 9b | 160.4 | 2.8 | 27 | ○ | 4.66 | 7 |
| | 9c | 164.4 | 2.7 | 33 | ○ | 3.42 | 10 |
| | 9d | 155.4 | 2.7 | 24 | ○ | 2.26 | 5 |
| | 10a | 177.2 | 2,4 | 41 | ○ | 3.03 | 12 |
| | 10b | 188.4 | 2.3 | 40 | ○ | 5.50 | 18 |
| | 11a | 161.1 | 3.7 | 24 | ○ | 2.45 | 10 |
| | 11b | 162.0 | 3.8 | 30 | ○ | 2.54 | 12 |
| | 12a | 152.4 | 3.1 | 24 | ○ | 1.81 | 5 |
| | 13a | 164.0 | 4.1 | 23 | ○ | 5.01 | 10 |
| | 14a | 152.4 | 3.3 | 28 | ○ | 3.71 | 7 |
| | 15a | 154.0 | 3.5 | 24 | ○ | 2.10 | 8 |
| | 16a | 164.4 | 3.8 | 36 | ○ | 4.60 | 20 |
| | 17a | 162.4 | 3.4 | 38 | ○ | 4.21 | 16 |
| | 18a | 168.8 | 3.6 | 34 | ○ | 4.14 | 24 |
| | 19a | 186.6 | 2.4 | 27 | ○ | 5.85 | 26 |
| | 20a | 173.1 | 2.7 | 38 | ○ | 4.38 | 18 |
| | 21a | 154.6 | 3.4 | 27 | ○ | 3.74 | 14 |
| | 22a | 177.4 | 3.1 | 32 | ○ | 5.66 | 17 |
| | 23a | 187.1 | 2.4 | 24 | ○ | 5.71 | 24 |
| | 24a | 177.3 | 2.9 | 40 | ○ | 4.74 | 17 |
| | 25a | 171.6 | 3.1 | 44 | ○ | 4.99 | 13 |
| | 26a | 159.8 | 3.4 | 40 | ○ | 5.27 | 21 |
| | 27a | 164.9 | 3.1 | 26 | ○ | 2.55 | 15 |
| | 27b | 165.5 | 3.2 | 28 | ○ | 4.24 | 18 |
| | 28a | 169.8 | 3.0 | 26 | ○ | 2.78 | 18 |
| | 29a | 165.6 | 3.1 | 25 | ○ | 4.42 | 17 |
| | 30a | 161.6 | 3.4 | 34 | ○ | 4.11 | 25 |
| | 31a | 164.4 | 3.6 | 27 | ○ | 4.11 | 13 |
| | 32a | 170.3 | 3.0 | 22 | ○ | 4.43 | 16 |
| | 33a | 166.2 | 3.0 | 24 | ○ | 3.94 | 15 |
| | 34a | 163.1 | 3.1 | 27 | ○ | 3.32 | 20 |
| | 34b | 165.4 | 3.1 | 29 | ○ | 4.74 | 21 |
| | 35a | 168.3 | 3.2 | 21 | ○ | 4.11 | 13 |
| | 36a | 174.4 | 2.9 | 24 | ○ | 3.88 | 11 |
| | 37a | 171.5 | 3.1 | 29 | ○ | 3.64 | 13 |
| | 38a | 167.4 | 3.4 | 28 | ○ | 4.11 | 10 |
| Conventional wire | 41a | 137.9 | 3.2 | 4 | ○ | 1.10 | 0 |

Moreover, the manufacturing methods of various kinds will be considered. Comapring of the methods Nos. 1b and 1d, higher the reduction rate W2 is higher both of tensile strength and the thermal expansion coefficent are. This is because of an increase in the amount of martensite transformation. Comparing the methods Nos. 1b and 1c, 3a and 3b, 9a and 9b, 10a and 10b, 27a and 27b, and 34a and 34b, respectively, the tensile strength is higher in either case when the aging treatment of H2 is performed. Also, comparing the methods Nos. 2a and 2b, when the working temperature is lower, transformation induced by working proceeds effectively for enhancing the strength.

Further, comparing the methods Nos. 9a, 9c and 9d, when the temperature Hi is changed, tensile strength can be changed even by working at the same reduction rate, and that the capacity of transformation induced by working can be controlled by utilizing the heat treatment. Besides, comparing the methods Nos. 11a and 11b, when the lubricant for the final dies is a wet type, the maximum height of the surface roughness is less than 3 $\mu$m, thereby taking effects in improvement of the torsional value.

On the other hand, it is understood that the conventional alloy No. 41 is not suitable for application as a core wire of a power-transmission line because when it is simply subjected to cold working after scalping, the average torsional value is as low as four times. Therefore, it is obvious that the manufacturing method of the invention alloy wire is a particularly effective manufacturing method of a low-thermal-expansion alloy wire containing the martensite phase induced by working.

As will be apparent from the above, the invention alloy can make compatible a high tensile strength of 150 kgf/mm$^2$ or more and the low thermal expansion coefficients of not greater than $6\times10^{-6}$/° C., and is suitable for parts which require dimensional accuracy and high strength. Especially when this alloy is formed into a wire, it is possible to obtain a tensile strength which is one grade higher than that of the conventional low-thermal-expansion alloy wire, i.e., which is substantially equal to or close to that of the piano wire, a torsional value which is constantly as high As that of the piano wire even if the manufacturing process is simple, and a low thermal expansion coefficient which is ½ or less of that of the piano wire. With the invention alloy wire, it is possible to produce a power-transmission line of a low sag degree which is highly reliable and which has a transmission capacity higher than the conventional power-transmission line with a core wire made of a piano wire. Consequently, the transmission capacity of the power-transmission line can be increased relatively easily.

What is claimed is:

1. An alloy wire of high strength and low thermal expansion, wherein:

the wire is made of an alloy which has a chemical composition of, by weight, 0.06% to 0.50% C, 65% or less Co, and less than 30% Ni in total amount of 25% to 65% of Co+Ni, and the balance being Fe as a main component, other optional elements and unavoidable impurities, and which has a primary phase of austenite phase and martensite phase induced by working, and wherein the wire has 150 kgf/mm$^2$ or more of tensile strength at normal temperature and an average thermal expansion coefficient of $6\times10^{-6}$/° C. or less at from normal temperature to 230° C.

2. An alloy wire of high strength and low thermal expansion, wherein:

the wire is made of an alloy which has a chemical composition of, by weight, 0.06% to 0.50% C, up to 1.5% Si, up to 3% Mn, 2% to 60% Co, and up to 30% Ni, the relationship between Co and Ni satisfying the following formula:

$$52-(5\ Ni/3)\leqq Co\leqq 65-(5\ Ni/3),$$

and up to 11% Cr, up to 6% W, and up to 6% Mo in a range which satisfies the following formula:

$$5-(Ni/4)\leqq Cr+0.54\ Mo+0.28\ W\leqq 11-(Ni/4),$$

and the balance being essentially Fe except for unavoidable impurities, and which has austenite phase and martensite phase induced by working, and wherein the wire has 150 kgf/mm$^2$ or more of tensile strength at normal temperature and an average thermal expansion coefficient of $6\times10^{-6}$/° C. or less at from normal temperature to 230° C.

3. An alloy wire of high strength and low thermal expansion, wherein:

the wire is made of an alloy which has a chemical composition of, by weight, 0.06% to 0.50% C, up to 1.5% Si, up to 3% Mn, more than 8% to 32% Co, and 12% to 30% Ni, the relationship between Co and Ni satisfying the following formula:

$$52-(5\ Ni/3)\leqq Co\leqq 65-(5\ Ni/3),$$

and up to 8% Cr, up to 6% W, and up to 6% Mo in a range which satisfies the following formula:

$$5-(Ni/4)\leqq Cr+0.54\ Mo+0.28\ W\leqq 11-(Ni/4),$$

and the balance being essentially Fe except for unavoidable impurities, and which has austenite phase and martensite phase induced by working, and wherein the wire has 150 kgf/mm$^2$ or more of tensile strength at normal temperature and an average thermal expansion coefficient of $6\times10^{-6}$/° C. or less at from normal temperature to 230° C.

4. An alloy wire of high strength and low thermal expansion, wherein:

the wire is made of an alloy which has a chemical composition of, by weight, 0.06% to 0.50% C, up to 1.5% Si, up to 3% Mn, more than 8% to 22% Co, and 18% to 30% Ni, the relationship between Co and Ni satisfying the following formula:

$$52-(5\ Ni/3)\leqq Co\leqq 65-(5\ Ni/3),$$

and up to 6.5% Cr, up to 5% W, and up to 5% Mo in a range which satisfies the following formula:

$$5-(Ni/4)\leqq Cr+0.54\ Mo+0.28\ W\leqq 11-(Ni/4),$$

and the balance being essentially Fe except for unavoidable impurities, and which has austenite phase and martensite phase induced by working, and wherein the wire has 150 kgf/mm$^2$ or more of tensile strength at normal temperature and an average thermal expansion coefficient of $6\times10^{-6}$/° C. or less at from normal temperature to 230° C.

5. An alloy wire of high strength and low thermal expansion, wherein:

the wire is made of an alloy which has a chemical composition of, by weight, 0.15% to 0.50% C, up to 1.5% Si, up to 3% Mn, more than 8% to 22% Co, and 18% to 30% Ni, the relationship between Co and Ni satisfying the following formula:

$$52-(5\ Ni/3)\leqq Co\leqq 65-(5\ Ni/3),$$

and up to 6.5% Cr, up to 5% W, and up to 5% Mo in a range which satisfies the following formula:

$$5-(Ni/4)\leqq Cr+0.54\ Mo+0.28\ W\leqq 11-(Ni/4),$$

and the balance being essentially Fe except for unavoidable impurities, and which has austenite phase and martensite phase induced by working, and wherein the wire has 150 kgf/mm$^2$ or more of tensile strength at normal temperature and an average thermal expansion coefficient of $6\times10^{-6}$/° C. or less at from normal temperature to 230° C.

6. An alloy wire of high strength and low thermal expansion, wherein:

the wire is made of an alloy which has a chemical composition of, by weight, 0.15% to 0.40% C, up to 0.5% Si, up to 1% Mn, more than 8% to 17% Co, and 21% to 29.5% Ni, the relationship between Co and Ni satisfying the following formula:

$$52-(5\ Ni/3)\leqq Co\leqq 65-(5\ Ni/3),$$

and up to 5.75% Cr, up to 4% W, and up to 4% Mo in a range which satisfies the following formula:

$$5-(Ni/4)\leqq Cr+0.54\ Mo+0.28\ W\leqq 11-(Ni/4),$$

and the balance being essentially Fe except for unavoidable impurities, and which has austenite phase and martensite phase induced by working, and wherein the wire has 150 kgf/mm$^2$ or more of tensile strength at normal temperature and an average thermal expansion coefficient of $6\times10^{-6}$/° C. or less at from normal temperature to 230° C.

7. An alloy wire of high strength and low thermal expansion, wherein:

the wire is made of an alloy which has a chemical composition of, by weight, 0.15% to 0.40% C, up to 0.5% Si, up to 1% Mn, more than 8% to 17% Co, and 21% to 29.5% Ni, the relationship between Co and Ni satisfying the following formula:

$$52-(5\ Ni/3)\leqq Co\leqq 65-(5\ Ni/3),$$

and the balance being essentially Fe except for unavoidable impurities, and which has austenite phase and martensite phase induced by working, and wherein the wire has 150 kgf/mm$^2$ or more of tensile strength at normal temperature and an average thermal expansion coefficient of $6\times10^{-6}$/° C. or less at from normal temperature to 230° C.

8. An alloy wire according to any one of claims 1 to 7, wherein Fe is partially substituted by at least one of 0.0001% to 0.02% B, 0.001% to 0.02% Mg, and 0.0001% to 0.02% Ca.

9. An alloy wire according to any one of claims 1 to 7, wherein Fe is partially substituted by at least one of V, Ti, Nb, Ta, Hf, and Zr in a range of not more than 1%.

10. An alloy wire according to any one of claims 1 to 7, wherein Fe is partially substituted by at least one of 0.001% to 0.02% Al and 0.001% to 0.2 REM.

11. An alloy wire according to any one of claims 1 to 7, wherein said wire has a torsional value of 15 times or more when the grip interval is 100 times as large as the diameter of the wire.

12. An alloy wire according to any one of claims 1 to 7, wherein said wire has a surface roughness of 3 microns or less in terms of the maximum height (Rmax).

* * * * *